US009389041B2

(12) United States Patent
Novikov

(10) Patent No.: US 9,389,041 B2
(45) Date of Patent: Jul. 12, 2016

(54) SPIRAL ELASTIC ELEMENT FOR A SHOOTING DEVICE

(71) Applicant: Gennady Novikov, Caluire et Cuire (FR)

(72) Inventor: Gennady Novikov, Caluire et Cuire (FR)

( * ) Notice: Subject to any disclaimer, the term of this patent is extended or adjusted under 35 U.S.C. 154(b) by 115 days.

(21) Appl. No.: 14/162,306

(22) Filed: Jan. 23, 2014

(65) Prior Publication Data

US 2014/0251294 A1 Sep. 11, 2014

(30) Foreign Application Priority Data

Mar. 6, 2013 (FR) ..... 13 52031

(51) Int. Cl.

| | |
|---|---|
| ***F41B 5/12*** | (2006.01) |
| ***F41B 7/00*** | (2006.01) |
| ***F41B 5/00*** | (2006.01) |
| ***F41B 5/14*** | (2006.01) |
| ***F41B 7/04*** | (2006.01) |

(52) U.S. Cl.

CPC ... *F41B 7/00* (2013.01); *F41B 5/00* (2013.01); *F41B 5/0094* (2013.01); *F41B 5/12* (2013.01); *F41B 5/1403* (2013.01); *F41B 7/04* (2013.01)

(58) Field of Classification Search

CPC ..... F41B 5/00; F41B 5/0094; F41B 5/12; F41B 5/14; F41B 5/1403; F41B 7/00; F41B 7/04; F41B 3/005; A63H 17/008; A63H 27/004; A63H 27/005; A63H 27/14; A63H 29/04; A63H 33/18

See application file for complete search history.

(56) References Cited

U.S. PATENT DOCUMENTS

| | | | | |
|---|---|---|---|---|
| 320,643 | A | 6/1885 | Engle | |
| 4,388,914 | A * | 6/1983 | Cesin | 124/27 |
| 4,879,987 | A | 11/1989 | Nishioka | |
| 4,903,677 | A | 2/1990 | Colley et al. | |
| 5,054,463 | A * | 10/1991 | Colley et al. | 124/25.6 |
| 5,353,777 | A * | 10/1994 | Fincher | 124/16 |
| 6,019,096 | A * | 2/2000 | Snyder et al. | 124/16 |
| 7,743,760 | B2 | 6/2010 | Woodland | |
| 2009/0032002 | A1 * | 2/2009 | Howard et al. | 124/25.6 |
| 2009/0033051 | A1 * | 2/2009 | Ahnert | 280/47.38 |
| 2010/0000504 | A1 * | 1/2010 | Trpkovski | 124/25.6 |
| 2012/0152220 | A1 | 6/2012 | Barber et al. | |

FOREIGN PATENT DOCUMENTS

| | | |
|---|---|---|
| DE | 939 556 | 2/1956 |
| DE | 10 2004 034 730 A1 | 2/2006 |
| WO | WO 2012/153166 A1 | 11/2012 |

OTHER PUBLICATIONS

Nov. 6, 2013 Search Report issued in French Patent Application No. FR1352031 9 (with English translation).
Nov. 6, 2013 Written Opinion issued in French Patent Application No. FR13520319 (with English translation).

* cited by examiner

*Primary Examiner* — John E Simms, Jr.
(74) *Attorney, Agent, or Firm* — Notaro, Michalos & Zaccaria P.C.

(57) ABSTRACT

The elastic shooting support device according to the present invention is made up of at least one spiral elastic element arranged on the body of a shooting support, the elastic element being fixed by one of its ends to said shooting support, while the other end is connected to a string that is brought from an idle position to a stretched position by winding and compressing the spiral elastic element.

12 Claims, 11 Drawing Sheets

SPIRAL ELASTIC ELEMENT FOR A SHOOTING DEVICE

The present invention relates to an elastic device made up of a spiral-shaped elastic element mounted on shooting devices or supports, for example such as crossbows, bows, marine guns for sport, recreation or hunting practice.

It will be noted that the principle of the construction of crossbows or bows has remained unchanged for centuries.

The operating principle of crossbows or bows is based primarily on the use of a linear elastic element, working in flexion, fastened to the side or the middle, and made up of one or two parts.

The curved profile geometry of the deformable branch or branches making up the linear elastic element of bows or crossbows predetermines their essential defects, which primarily consists of the non-coincidence of the tension vectors of the string applied to the arrow or projectile.

In fact, the force created by the movement of the free end of the elastic element is oriented tangentially toward the bow of the crossbow, traced by it and is made up of two components: one is progressive and the other perpendicular to the axis of acceleration of the arrow that is supported by the longitudinal axis of the crossbow.

FIGS. 1 and 3 for example provide a diagrammatic illustration of the operating principle of a crossbow known in itself. Thus, in the obtained deformable parallelogram of the forces, the speed rate or movement speed of the string in the direction of the axis of the crossbow is always lower than its speed rate at the fastening points with the dominance of the transverse element during righting of the bow.

Consequently, the progressive speed rate or the progressive movement speed of the string and the progressive force, communicated to the arrow by the string, will decrease to zero proportionally to the cosine of the angle, created by the string and the longitudinal axis of the crossbow according to the following formulas:

$$V_{progressive}=V\times\cos ABC \text{ or } F_{progressive}=F\times\cos ABC$$

This proportional decrease of the progressive speed and the progressive force is increased as a function of the dimensions d of the branches of the bow of the crossbow, which may not exceed 900 mm.

In fact, under these conditions, it will be noted that the string accelerates the arrow over a distance df of only 250 mm, i.e., half of the path of the string, and after the speed of the string decreases and acquires a delay with respect to the speed of the arrow.

Known from prior patents U.S. Pat. No. 4,879,987 and U.S. Pat. No. 7,743,760 are elastic devices for crossbows including linear elastic elements whereof the curve of the branches of the bow is positioned in the direction opposite that commonly used, i.e., the inside of the curve of the bow is oriented across from the pulling direction of the string on the one hand and, at the ends of the linear elastic elements, force-reacting pulleys on the other hand.

However, it will be noted that the developments described and illustrated in the prior documents above do not eliminate the primary drawbacks related to the elastic linear elements as previously explained.

The present invention aims to resolve the aforementioned drawbacks by replacing the curved profile geometry of the deformable branch(es) making up the linear elastic element of the bows or crossbows or marine guns with one or more spiral elastic elements arranged on the body of the shooting support.

The elastic shooting support device according to the present invention is made up of at least one spiral elastic element arranged on the body of a shooting support, said elastic element being fixed by one of its ends to said shooting support, while the other end is connected to a string that is brought from an idle position to a stretched position by winding and compressing the spiral elastic element.

The elastic shooting support device according to the present invention is made up, for each elastic element, of a leaf spring wound in the shape of a spiral whereof the first central end makes it possible to fix said element on the body of the shooting support, while the second opposite end includes fastening means for fastening the string.

The elastic shooting support device according to the present invention comprises, for each spiral leaf spring, an outer profile including a central groove receiving the profile of the string.

The elastic shooting support device according to the present invention is made up of at least two spiral leaves that are positioned in a horizontal winding plane at one of the ends of the shooting support, the body of which has a crossbow profile.

The elastic shooting support device according to the present invention is made up of a spiral leaf that is positioned in a vertical winding plane at one of the ends of the shooting support whereof the body has a crossbow profile.

The elastic shooting support device according to the present invention is made up of at least two spiral leaves that are positioned in a vertical winding plane at each end of a shooting support whereof the body has a bow profile.

The elastic shooting support device according to the present invention comprises a spiral leaf spring that is made from a plastic material including fiberglass and carbon.

The elastic shooting support device according to the present invention comprises spiral leaf springs that are respectively fixed on a horizontal square secured on either side of a barrel of the crossbow body by means of a fastening axis with a non-cylindrical profile cooperating on the one hand with a bore with a complementary shape formed at the first central end and on the other hand with gripping means making it possible to axially position said spiral leaf springs with respect to the longitudinal axis of said barrel and to lock their rotation around said fastening axis.

The elastic shooting support device according to the present invention comprises spiral leaf springs that are positioned axially on the corresponding horizontal squares such that each second end is located near and in a direction parallel to that of the longitudinal axis of the barrel of the body of the crossbow.

The elastic shooting support device according to the present invention is made up of a leaf spring secured to the first square whereof the second end is fastened to a first loop of the string, while the second end of the other spiral leaf spring mounted on the second square is fastened to a second loop of said string.

The elastic shooting support device according to the present invention comprises a string that includes, between its two loops, a fastening area for placing and temporarily fastening the arrow or projectile.

The elastic shooting support device according to the present invention comprises spiral leaf springs that are respectively protected by a protective cover.

The elastic shooting support device according to the present invention comprises a spiral leaf spring that is fastened between the extensions of two half-flanges secured to a barrel of the body of the crossbow by means of a fastening axis with a non-cylindrical profile cooperating on the one hand with a bore with a complementary shape formed at the first central end and on the other hand with gripping means making it possible to axially position said spiral leaf springs with respect to the longitudinal axis of said barrel and to lock their rotation around said fastening axis.

The elastic shooting support device according to the present invention comprises a spiral spring leaf that is positioned axially between the extensions of the two half-flanges such that the second end is placed in the longitudinal axis of the barrel of the body of the crossbow.

The elastic shooting support device according to the present invention comprises a spiral leaf spring whereof the second end is fastened to one of the ends of the single strand forming the string, while the other end of said single strand is connected to a propulsion device.

The elastic shooting support device according to the present invention comprises a propulsion device laterally including two guide tabs cooperating with slots respectively formed in the half-flanges so as to guide and drive said propulsion device above a guideway formed in the barrel of the body of the crossbow to simultaneously bring the string from an idle position to a stretched position and the spiral leaf spring from an idle position to a compressed position.

The elastic shooting support device according to the present invention comprises a propulsion device including, perpendicular to the guide tabs and in a vertical direction emerging above the half-flanges, an abutment making up a propeller when the arrow or the projectile is in contact therewith.

The elastic shooting support device according to the present invention comprises spiral leaf springs that are respectively fastened to each end of an arm of the body of the bow by means of a fastening axis with a non-cylindrical profile cooperating on the one hand with a bore having a complementary shape formed at the first central end and on the other hand with gripping means making it possible to axially position each spiral leaf spring and to lock the rotation of said spiral leaf springs around said fastening axis.

The elastic shooting support device according to the present invention comprises spiral leaf springs that are positioned axially so as to wind in a vertical plane parallel to that of the face of the arm such that each second end joined by the string is substantially oriented toward a gripping handle formed on said arm.

The following description in light of the appended drawings, which are provided as non-limiting examples, will make it possible to better understand the invention, the features thereof, and the advantages it may impart:

Figure 4:
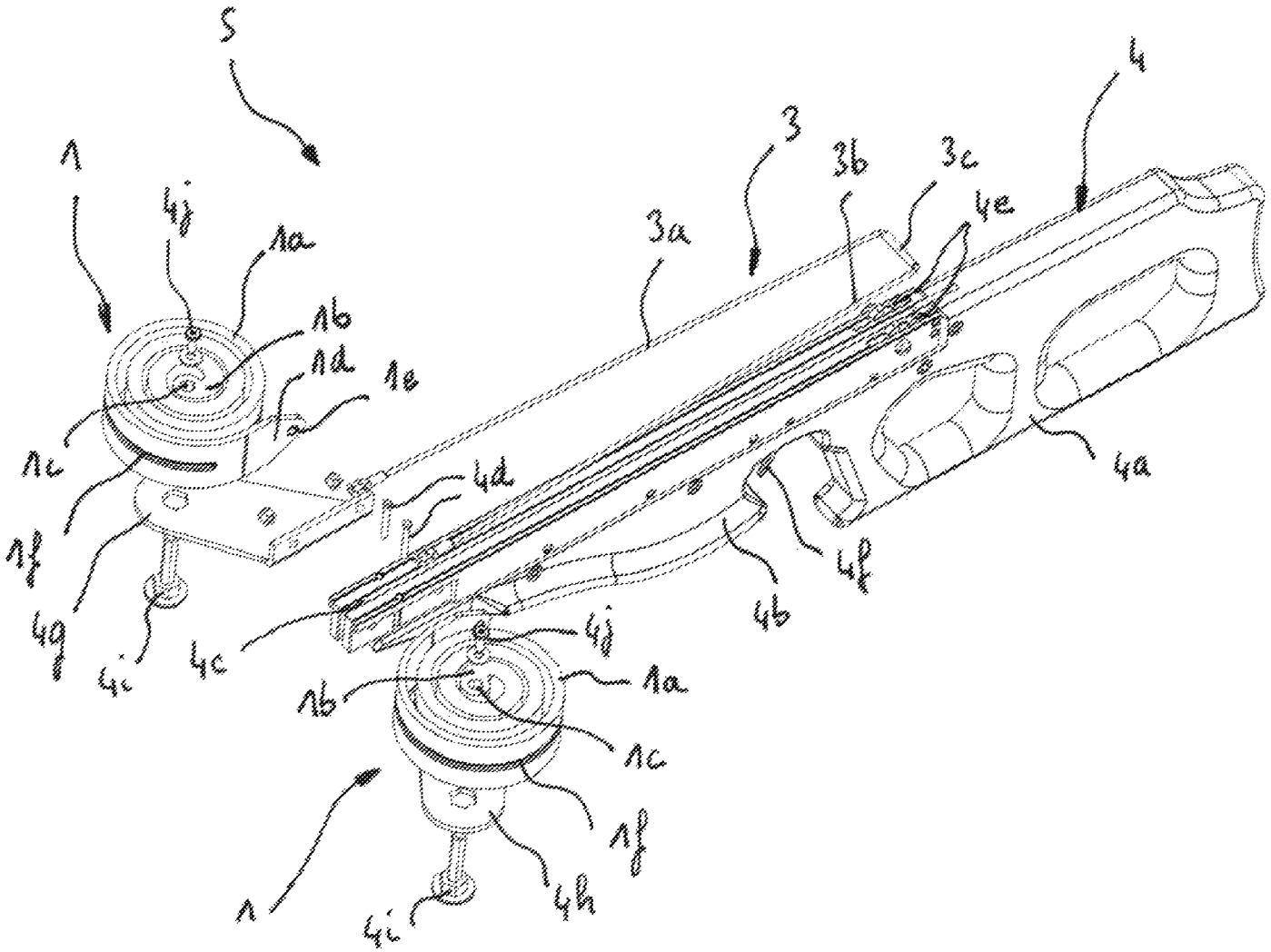
FIGS. 4 to 6 are perspective views showing a shooting support of the crossbow type comprising two spiral elastic elements arranged in a horizontal winding plane according to the present invention.
Figure 5:
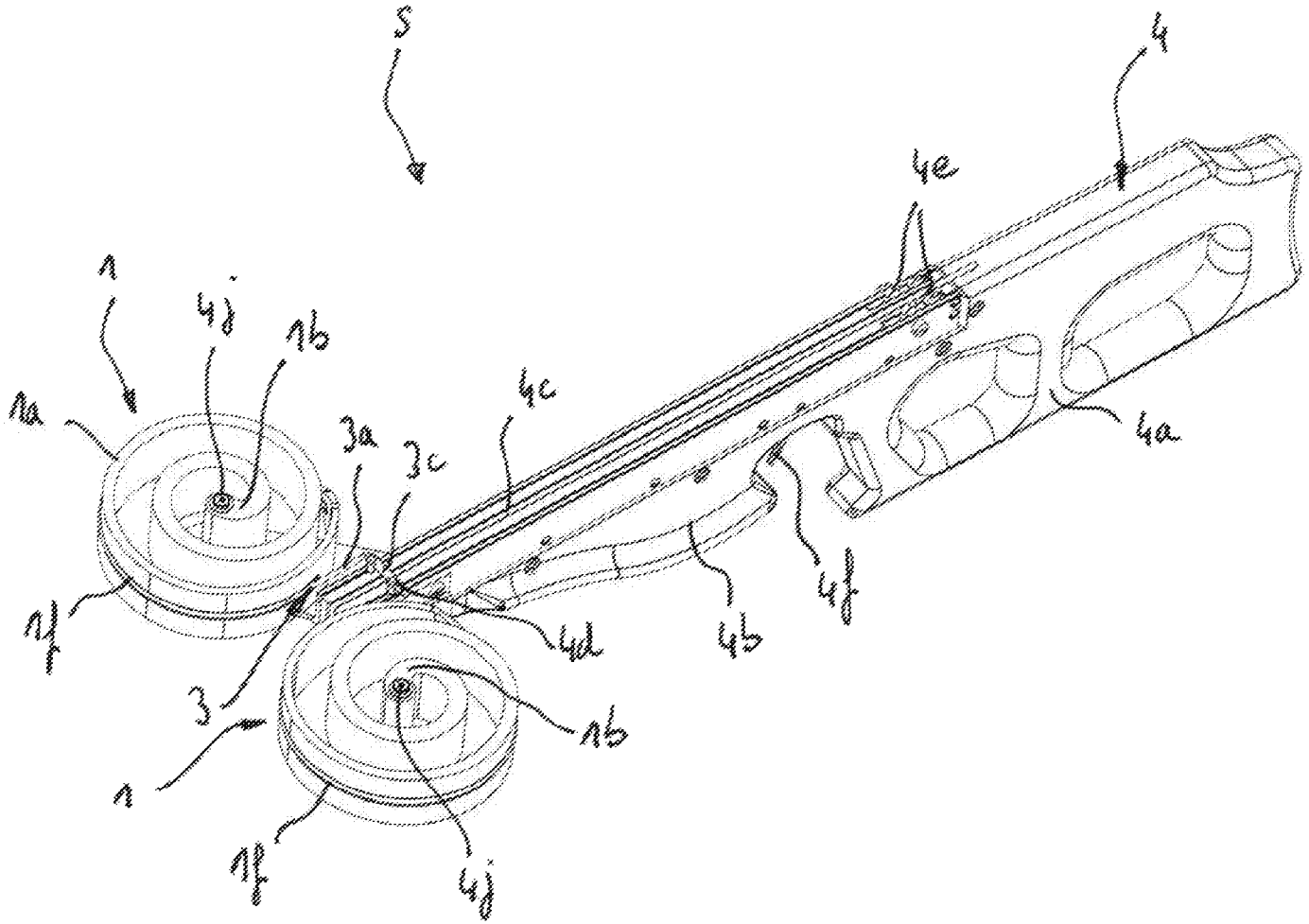
Figure 6:
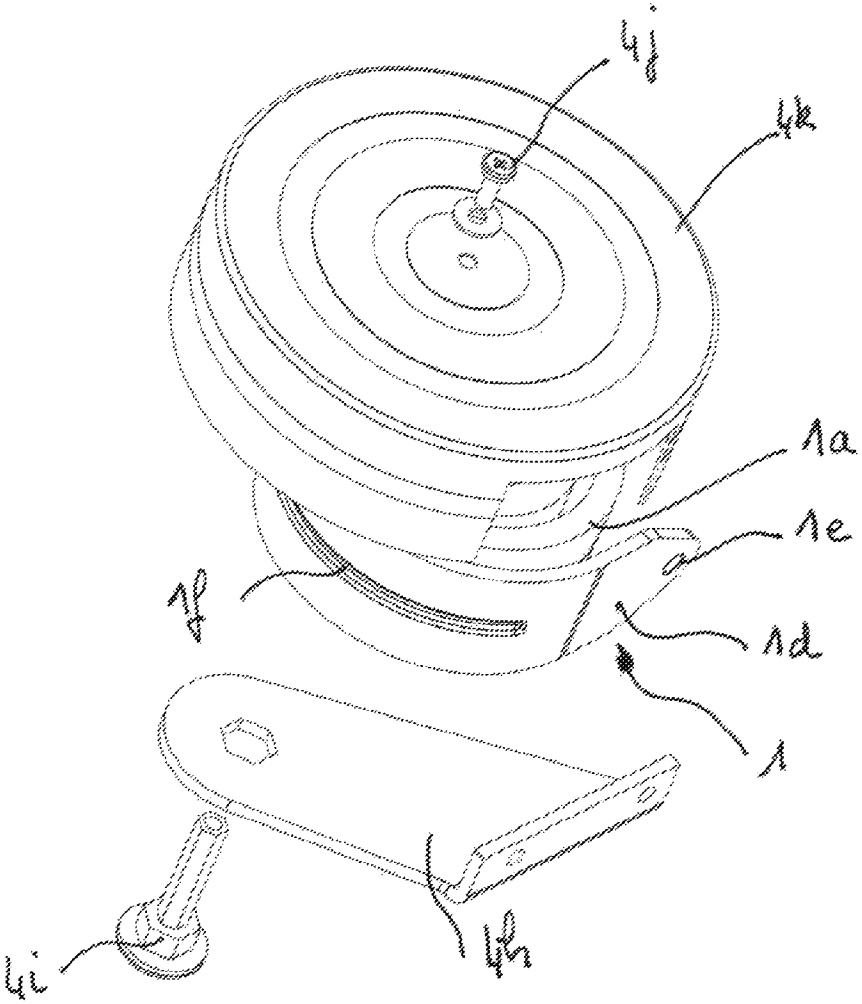

FIGS. 4 to 6 show a shooting support S of the crossbow type comprising a body 4 on which, at one of its ends, spiral elastic elements 1 connected to a string 3 are arranged that can go from an idle position to a stretched position.

The body 4 for example includes a grip 4*a* for holding the crossbow extending by a barrel 4*b* comprising, in the upper and horizontal part, a guideway 4*c* for guiding the arrow or the projectile.

The guideway 4*c* comprises, at one of its ends, end-of-travel abutments 4*d* of the string 3 when the latter is in the idle position and across from articulated latches 4*e* for locking said string in the stretched position.

The articulated latches 4*e* are connected to a trigger 4*f* positioned below the guideway 4*c* between the barrel 4*b* and the grip 4*a*.

The body 4 of the crossbow is secured to the free end of the barrel 413 of two lateral squares 4*g*, 4*h* positioned in a horizontal plane and from which a fastening axis 4*i* with a non-cylindrical outer profile respectively extends vertically.

Each elastic element 1 is made up of a leaf spring 1*a* wound in a spiral for example made from a plastic material including fiberglass and carbon.

Each elastic element 1 is made up of a leaf spring 1*a* wound in a spiral comprising a first so-called central end 1*b* pierced with a bore 1*c*.

The bore 1*c* of each leaf spring 1*a* has an inner profile complementary to that formed for the fastening axis 4*i* making it possible, during mounting of the leaf spring 1*a* on the corresponding square 4*g*, 4*h*, to be positioned axially with respect to the longitudinal axis of the barrel 4*b* on the one hand and locked in rotation around said fastening axis 4*i* on the other hand.

Each spiral leaf spring 1*a* is vertically immobilized on the fastening axis 4*i* by gripping means 4*i* for example screwing inside said axis.

Each leaf spring 1*a* includes, across from the first so-called central end 1*b*, a second end 1*d* for example pierced with a hole 1*e* so as to form fastening means for fastening the string 3.

The spiral leaf springs 1*a* are mounted on the corresponding squares 4*g*, 4*h* such that each second end 1*d* is positioned near and in a direction parallel to that of the longitudinal axis of the barrel 4*b* of the body 4 of the crossbow.

The string 3 includes a first loop 3*a* that is fastened to the second end 1*d* of the leaf spring 1*a* secured to the square 4*g*, while the second loop 3*b* is fastened to the second end 1*d* of the other leaf spring 1*a* mounted on the square 4*h* secured to the body 4 of the crossbow.

The string 3 includes, between its two loops 3*a* and 3*b*, a fastening area 3*c* for placing and temporarily fastening the arrow or projectile.

Each leaf spring 1*a* includes, on its outer profile, an axial groove 1*f* inside which the corresponding loop 3*a*, 3*b* of the string 3 winds, when the latter is idle.

The string 3 goes from an idle position bearing against the end-of-travel abutments 4*d* to a stretched position with its fastening area 3*c* housed inside hinged latches 4*e* either using a stretching device (not shown), or manually by the shooter to arm the crossbow.

The movement of the string 3 makes it possible to compress, respectively by winding, each spiral leaf spring 1*a* around the vertical axis 4*i* and to place the crossbow in the shooting position.

A protective cover 4*k* can be mounted around each leaf spring 1*a*, making it possible to avoid the deformations of the outer face of the spiral bearing the string 3 when the latter returns to its non-compressed and idle position.

The cover 4*k* also makes it possible to protect the shooter in case of deterioration either of the string 3 or the leaf spring 1*a*.

The cover 4*k* can make it possible to slow the deformation of each leaf spring 1*a* when shooting blank, i.e., without a projectile.

Figure 7:
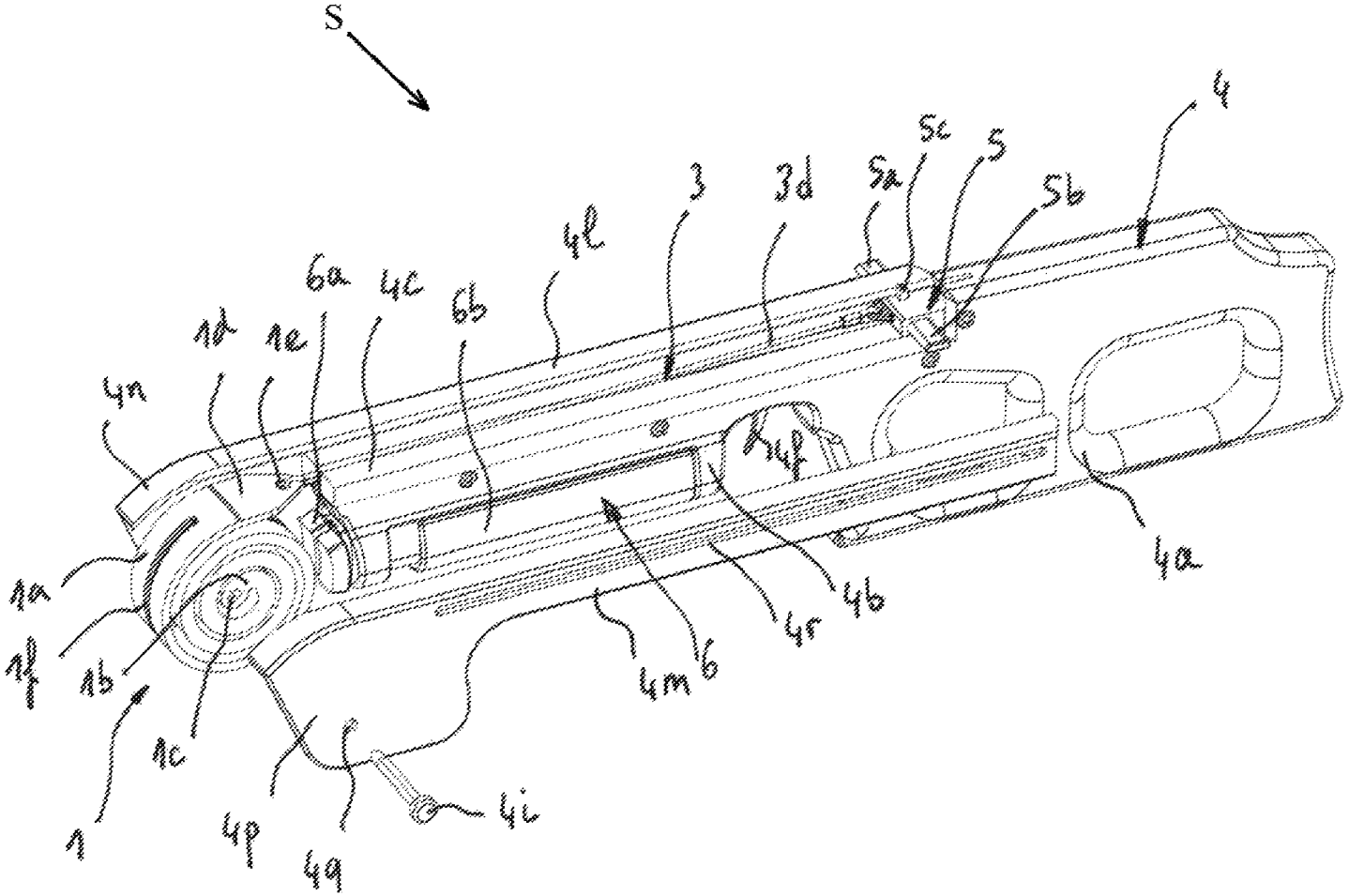
FIGS. 7, 8A and 8B are perspective views showing a shooting support of the crossbow type comprising a spiral elastic element arranged in a vertical winding plane according to the present invention.
Figures 8A, 8B:
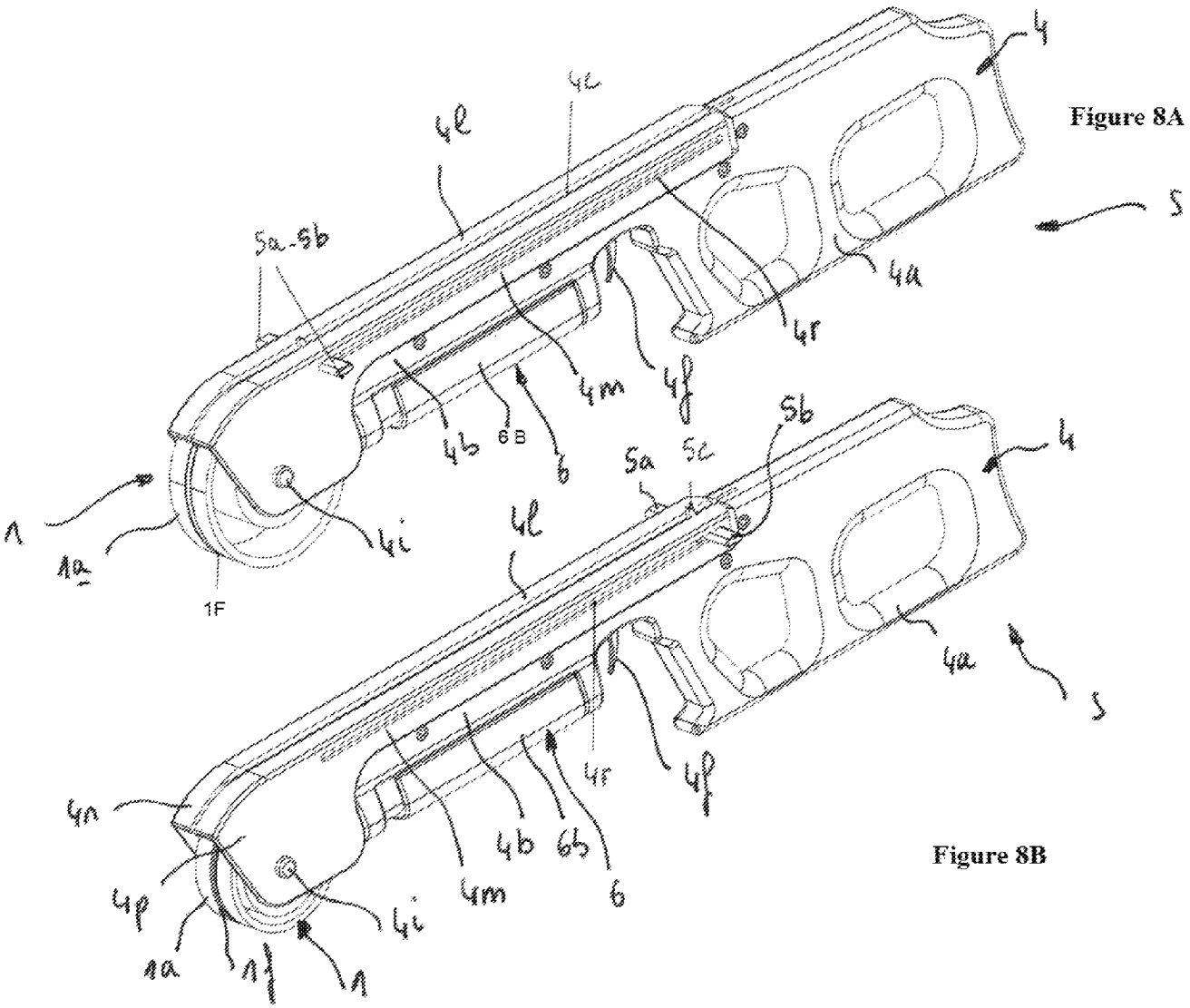

FIGS. 7, 8A and 8B show a shooting support S of the crossbow type comprising a body 4 on which, at one of its ends, a spiral elastic element 1 is arranged connected to a string 3 that can go from an idle position to a stretched position.

The shooting support S differs from that previously described only in that it includes a single elastic element 1 made up of a spiral leaf spring 1*a* winding in a vertical plane.

The body 4 is secured along its barrel 4*b* to two half-flanges 4*l*, 4*m*, extending outside said barrel and covering the guideway 4*c*.

Each half-flange 4*l*, 4*m* includes an extension 4*n*, 4*p* pierced with a horizontal bore 4*q* that is passed through by the fastening axis 4*i* to fasten the spiral leaf spring 1*a*.

Thus, the spiral leaf spring 1*a* is immobilized in rotation between the extensions 4*n*, 4*n* of the half-flanges 4*l*, 4*m* by means of the complementary profile of the bore 1*c* of said leaf, which cooperates with the fastening axis 4*i* with a non-cylindrical profile and the gripping means 4*j*.

The leaf spring 1*a* is axially positioned between the extensions 4*n*, 4*p* of the half-flanges 4*l*, 4*m* such that the second end 1*d* is placed in the longitudinal axis of the barrel 4*b* of the body 4 of the crossbow bearing the guideway 4*c* so as to be able to connect the single strand 3*d* forming the string 3 to said second end.

Thus, one of the ends of the single strand 3*d* of the string 3 is fastened to the second end 1*d* of the leaf spring 1*a*, while the other end is connected to a propulsion device 5.

The propulsion device 5 laterally includes two guide tabs 5*a*, 5*b* cooperating with slots 4*r*, 4*s* respectively formed in the half-flange 4*l*, 4*m* so as to guide and drive a propulsion device above the guideway 4*c* to simultaneously bring the string 3 from an idle position to a stretched position and the spiral leaf spring 1*a* from an idle position to a compressed position.

The propulsion device 5 includes, perpendicular to the guide tabs 5*a*, 5*b* and in a vertical direction emerging above the half-flanges 4*l*, 4*m*, an abutment 5*c* forming a propeller when the arrow or the projectile is in contact therewith.

The propulsion device 5 is locked in position in the articulated latches 4*e* of the guideway 4*c* when the single strand 3*d* of the string 3 is brought into the stretched position (FIGS. 7 and 8B), said articulated latches 4*e* being connected with the trigger 4*f* so as to be able to release the propulsion device 5 during shooting of the arrow or the projectile (FIG. 8A).

The propulsion device 5 may be moved either manually by the shooter or using a stretching device (not shown) to arm the crossbow.

The body 4 of the crossbow, and more particularly the barrel 4*b*, may include a braking device 6 that is made up of a skate 6*a* controlled by a push-piece 6*b* sliding on the lower part of said barrel. The skate 6*a* is brought by the push-piece 613 against the outer periphery of the spiral leaf spring 1*a* so as to brake the discharge of said leaf.

It will be noted that in this type of arrangement, the force created by the spiral leaf spring 1*a* coincides with the direction of the acceleration of the arrow projected by the propulsion device 5. Thus, the direction of the deformation of the spiral leaf spring 1*a* ensures compensation of the capsizing momentum during shooting that occurs after the shooting line has been crossed with respect to the line of the grip 4*a*.

Figure 9:
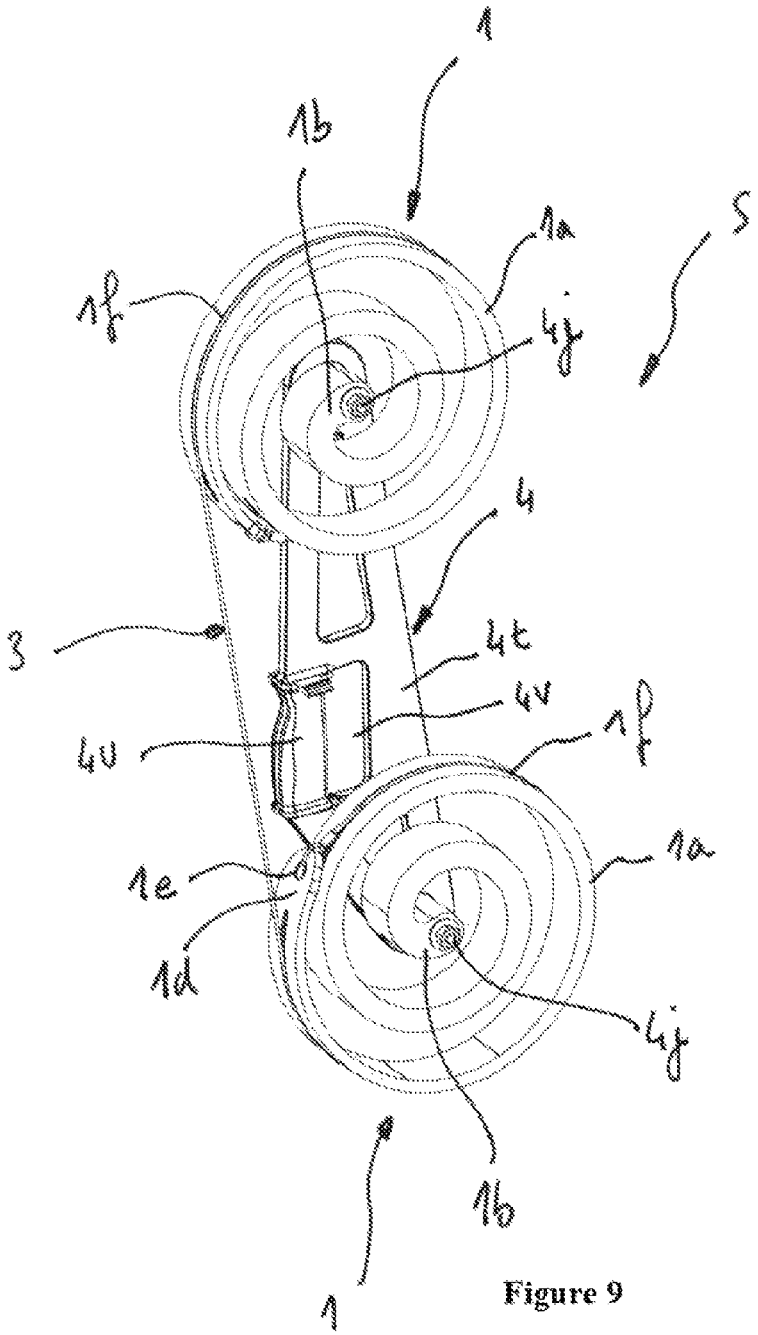
FIGS. 9 and 10 are perspective views illustrating a shooting support of the bow type comprising two spiral elastic elements arranged in a vertical winding plane according to the present invention.
Figure 10:
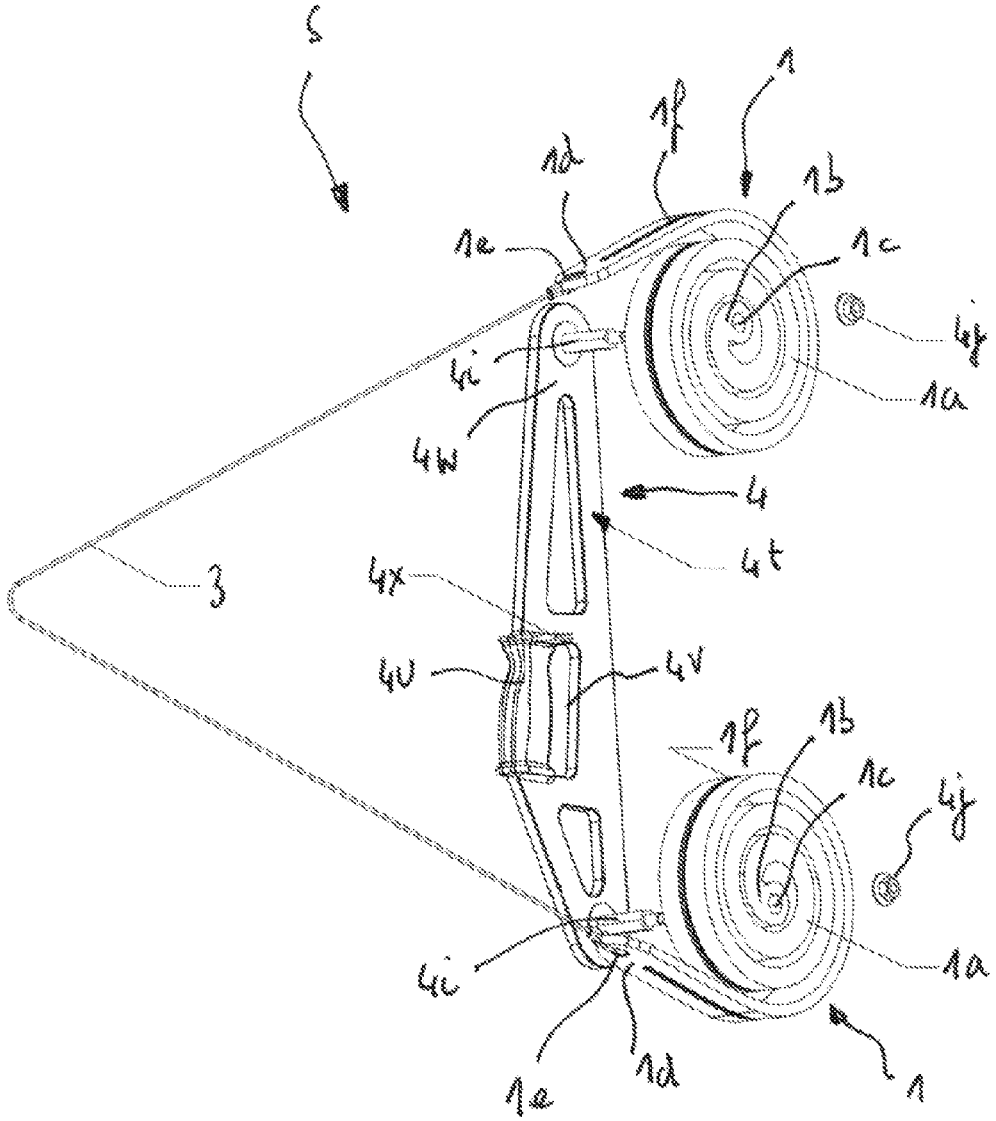

FIGS. 9 and 10 show a shooting support S of the bow type comprising a body 4 on which a spiral elastic element 1 is arranged at each end, said spiral elastic element being connected to a string 3 that can go from an idle position to a stretched position.

The body 4 is made up of an arm 4*t* whereof the profile may for example be triangular, provided on one of its sides with a gripping handle 4*u* emerging in an oblong opening 4*v* for the passage of the fingers of the shooter's hand.

The arm 4*t* is secured on one of its faces 4*w* and at its furthest ends, with two fastening axes 4*i* that have a non-cylindrical profile extending in a direction perpendicular to that containing the face 4*w* of the arm 4*t*.

The upper edge of the gripping handle 4*u* located in the plane of the face 4*w* is secured to a support 4*x* making it possible to support the arrow or projectile to be launched.

On each fastening axis 4*i*, an elastic element 1 made up of a spiral leaf spring 1*a* winding in a vertical plane parallel to that of the face 4*w* of the arm 4*t* is immobilized by gripping means 4*j*.

Thus, each spiral leaf spring 1*a* is immobilized in rotation in an axial position determined using the complementary profile of the bore 1*c* of said leaf that cooperates with the fastening axis 4*i* with a non-cylindrical profile and the gripping means 4*j*.

The axial position of each spiral leaf spring 1*a* is obtained once the second end 1*d* connected to one of the ends of the string 3 is substantially oriented toward the gripping handle 4*u* of the arm 4*t* such that said string 3, housed in the axial groove 1*f* and connecting said spiral leaf springs 1*a*, is placed in a plane parallel to that of the largest side of the arm 4*t*.

Operation

It will be understood from the above description that the shooting support S equipped with at least one spiral elastic element (1) makes it possible to completely resolve the aforementioned drawbacks.

In fact, the tension of the string 3 corresponds to the deformation of the spiral leaf spring(s) 1*a*, which perform(s) approximately one 360° revolution with respect to the stationary point thereof embodied by the fastening axis 4*i* through the unwinding of said string 3. However, the travel of the string 3 is equal to the length of the circle formed by the spiral in the idle state of the leaf spring(s) 1*a*.

Thus, to obtain the optimal distance for the acceleration of the arrow, i.e., over the entire length L of the guideway 4*c*, the maximum diameter D of the elastic element 1 may be defined as $D=L/\pi$ where L is the travel of the string 3, which determines the minimal frontal projection of the crossbow.

Furthermore, one can see that the spiral elastic element 1 according to the invention does not create recoil and the speed of the arrow is equal to the speed of the free end of the spiral elastic element 1 and increases during the deformation of the spiral over the entire length of the trajectory.

Additionally, it will be noted that the speed of the arrow increases as a function of the progression of the deformation of the spiral of each elastic element 1 and the enlargement of the outer diameter of said spiral.

One can see that the advantages of shooting supports S including at least one spiral elastic element 1 may be as follows:

a) The force acting on the arrow is proportional to the cos of the angle ABC between the direction of movement of the arrow and the fastening points of the string 3 on the elastic element 1, i.e., F×cos ABC, where F is the compression force of the bow.

Figure 1:
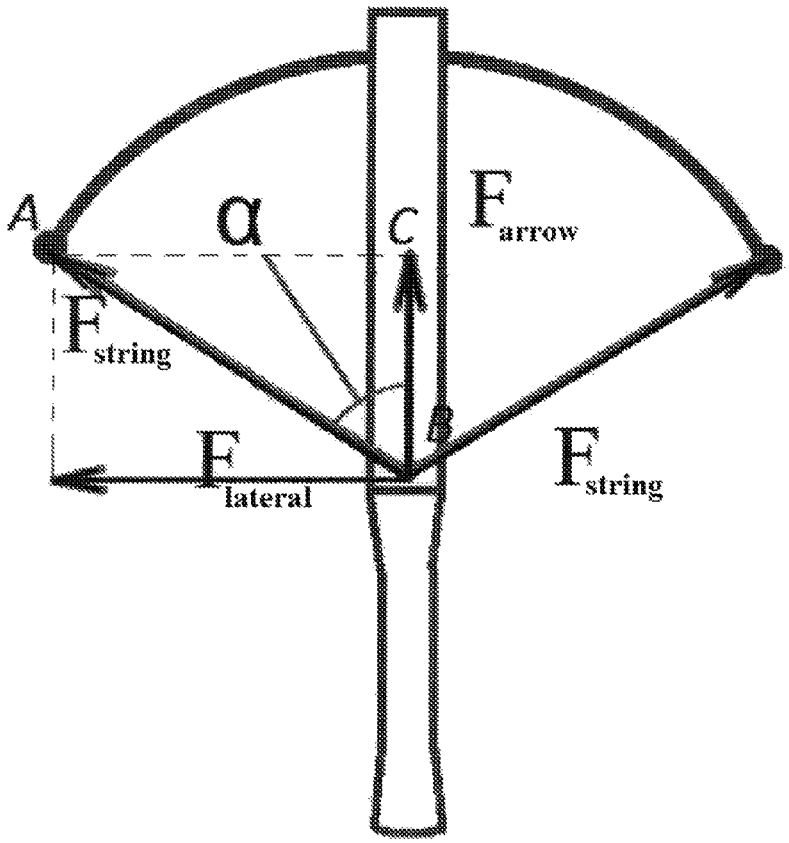
FIGS. 1, 2 and 3 are views illustrating the movements and forces of a string for shooting an arrow using linear elastic elements obtained by the curvature of the branches of the bow of a crossbow known in itself.
Figure 2:
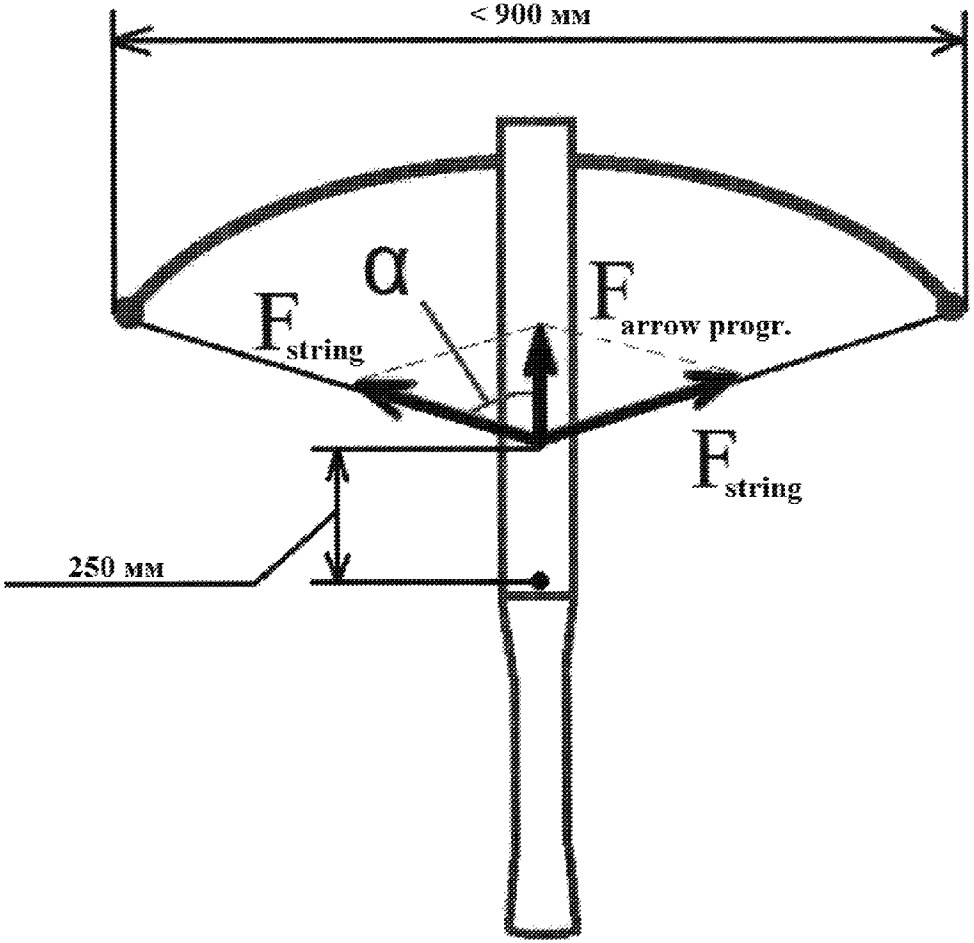
Figure 3:
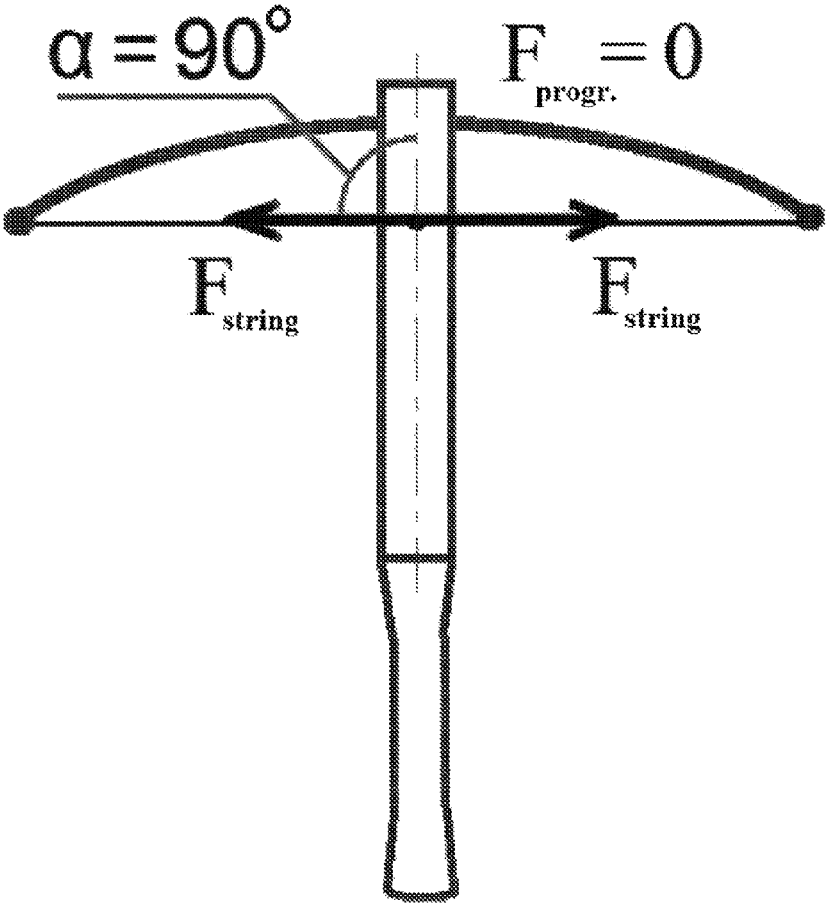

In the traditional configuration of the crossbow, the angle ABC during straightening of the bow increases from 45° to 90°, the force of the elastic element is partially transferred to the arrow at the initial part of the trajectory with coefficient $1/\sqrt{2}$ (cos 45°), i.e., only 70%, and drops to zero when the bow is righted (FIG. 3).

In the configuration according to the invention of a shooting support S including at least one spiral elastic element 1, it will be noted that the angle ABC is practically constant and allows the arrow to receive at least 99% of the force from the deformation of the spiral elastic element 1.

Figure 11:
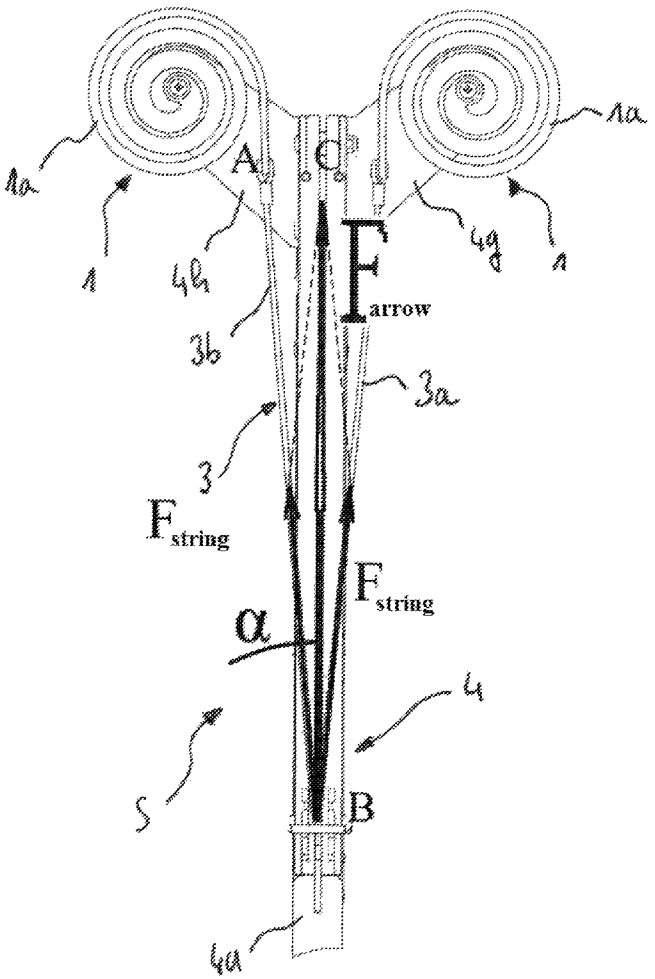
FIG. 11 is a diagrammatic view showing the comparison of the forces and the speed between a crossbow known in itself and a crossbow according to the present invention.
Figure 11:
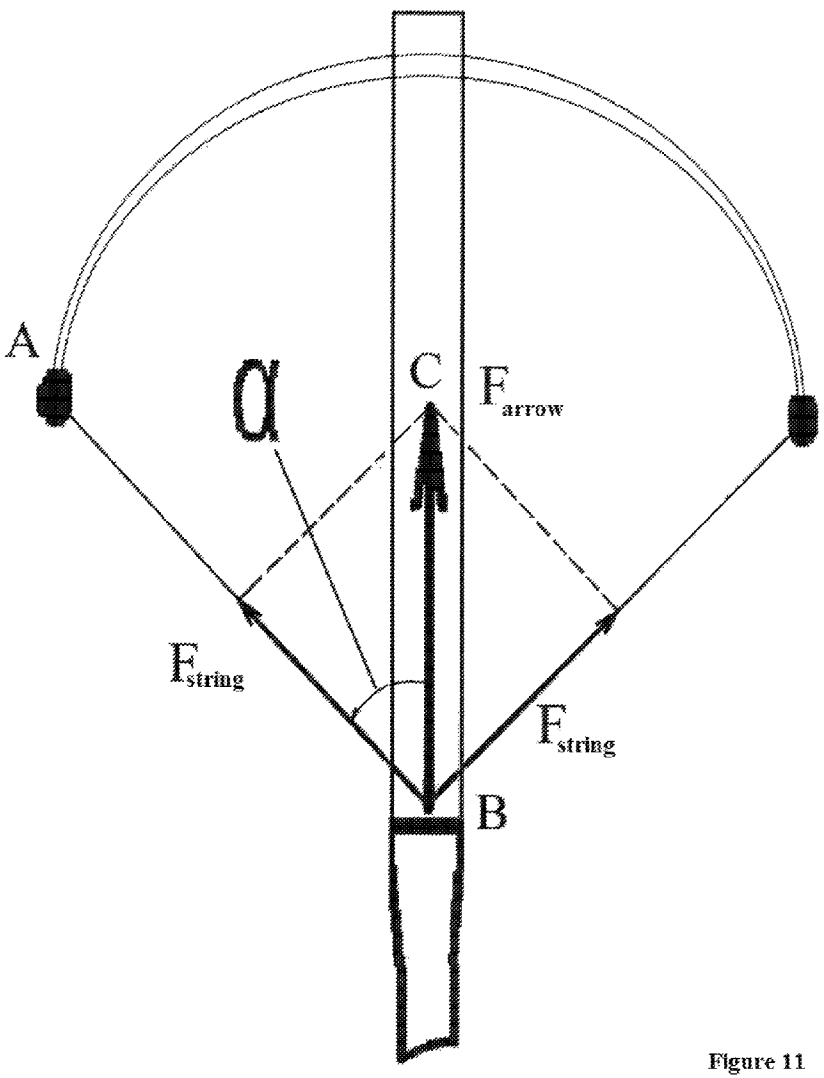

In conclusion, to obtain equal speed rates of the arrow, it is necessary to have pressure resulting from the compression of the spiral elastic element 1 that is half that of a linear element (FIG. 11).

b) Newton's second principle states that with constant force F of the string 3 and mass m of the arrow, its final speed rate or speed will be directly proportional to the duration of the application of force according to $F \times T = m \times (V - V0)$.

One will note that by multiplying the advantage in the force applied to the arrow (point a) by its action time, we reach the conclusion that the speed rate or the speed of the arrow for a shooting support S including one or more spiral elastic elements 1 increases up to 3 times.

It must also be understood that the preceding description has been provided solely as an example and in no way limits the field of the invention, and it would not be outside that field to replace the details of the described embodiments with any equivalent means.

The invention claimed is:

1. An elastic shooting support device, comprising:

at least one spiral elastic element arranged on a body of a shooting support, said spiral elastic element being fixed by a first central end to said shooting support, while a second end, opposite to the first end is connected to a string that is brought from an idle position to a stretched position by winding and compressing the spiral elastic element wherein each spiral elastic element is made up of a leaf spring wound in a spiral shape whereof the first central end enables said spiral elastic element to be fixed on the body of the shooting support, while the second end, from outer side of spiral includes a fastening element for fastening the string, wherein the spiral leaf springs are respectively fixed on a horizontal square secured on either side of a barrel of the body of the shooting support by a fastening axis with a non-cylindrical profile cooperating on the one hand with a bore with a complementary shape formed at the first central end and on the other hand with a gripping element to enable said spiral leaf springs to be axially positioned with respect to a longitudinal axis of said barrel and to lock rotation of said spiral leaf springs around said fastening axis.

2. The elastic shooting support device according to claim 1, wherein the spiral leaf springs are positioned axially on the corresponding horizontal squares such that each second end is located near and in a direction parallel to that of the longitudinal axis of the barrel of the body of the shooting support.

3. The elastic shooting support device according to claim 2, wherein the second end of a first one of the spiral leaf springs secured to the square is fixed to a first loop of the string while the second end of a second one of the spiral leaf springs mounted on the square is fixed to a second loop of said string.

4. The elastic shooting support device according to claim 3, wherein the string includes, between the first loop and the second loop, a fastening area for placing and temporarily fastening an arrow or a projectile.

5. The elastic shooting support device according to claim 1, wherein the spiral leaf springs are respectively protected by a protective cover.

6. The elastic shooting support device according to claim 1, wherein the spiral leaf spring is fastened between extensions of two half-flanges secured to a barrel of the body of the shooting support by a fastening axis with a non-cylindrical profile cooperating on the one hand with a bore with a complementary shape formed at the first central end and on the other hand with a gripping element to enable said spiral leaf springs to be axially positioned with respect to a longitudinal axis of said barrel and to lock rotation of said spiral leaf springs around said fastening axis.

7. The elastic shooting support device according to claim 6, wherein the spiral spring leaf is positioned axially between the two half-flanges such that the second end is placed in the longitudinal axis of the barrel of the body of the shooting support.

8. The elastic shooting support device according to claim 7, wherein the second end of the spiral leaf spring is fastened to one end of a single strand forming the string, while a second end of said single strand is connected to a propulsion device.

9. The elastic shooting support device according to claim 8, wherein the propulsion device laterally includes two guide tabs cooperating with slots respectively formed in the two half-flanges so as to guide and drive said propulsion device above a guideway formed in the barrel of the body of the shooting support to simultaneously bring the string from an idle position to a stretched position and the spiral leaf spring from an idle position to a compressed position.

10. The elastic shooting support device according to claim 9, wherein the propulsion device includes, perpendicular to the two guide tabs and in a vertical direction emerging above the half-flanges, an abutment making up a propeller when the arrow or the projectile is in contact therewith.

11. The elastic shooting support device according to claim 1, wherein the spiral leaf springs are respectively fastened to each end of an arm of the body of the shooting support by a fastening axis with a non-cylindrical profile cooperating on the one hand with a bore having a complementary shape formed at the first central end and on the other hand with a gripping element to enable each spiral leaf spring to be axially positioned and to lock the rotation of said spiral leaf springs around said fastening axis.

12. The elastic shooting support device according to claim 11, wherein the spiral leaf springs are positioned axially so as to wind in a vertical plane parallel to that of a face of the arm such that each second end joined by the string is substantially oriented toward a gripping handle formed on said arm.

* * * * *